United States Patent [19]

Abys

[11] Patent Number: 4,478,691

[45] Date of Patent: Oct. 23, 1984

[54] SILVER PLATING PROCEDURE

[75] Inventor: Joseph A. Abys, Bridgewater, N.J.

[73] Assignee: AT&T Bell Laboratories, Murray Hill, N.J.

[21] Appl. No.: 512,695

[22] Filed: Jul. 11, 1983

Related U.S. Application Data

[63] Continuation of Ser. No. 310,610, Oct. 13, 1981, abandoned.

[51] Int. Cl.[3] ..... C25D 3/46; C25D 3/64

[52] U.S. Cl. ..... 204/43 R; 204/44; 204/45 R

[58] Field of Search ..... 204/46.1, 43.1, 44.3, 204/44.5, 44, 109, 123, 44.6

[56] References Cited

U.S. PATENT DOCUMENTS

| | | | |
|---|---|---|---|
| 2,355,070 | 8/1944 | Harford | 204/46.1 |
| 2,660,554 | 11/1953 | Ostrow | 204/46.1 X |
| 2,666,738 | 1/1954 | Kardos | 204/46 |
| 2,735,808 | 2/1956 | Greenspan | 204/46 |
| 2,777,810 | 1/1957 | Ostrow | 204/46 |
| 4,088,549 | 5/1978 | Deuber | 204/44.3 |
| 4,265,715 | 5/1981 | Rosegren et al. | 204/46 |

OTHER PUBLICATIONS

S. R. Natarajan et al., Metal Finishing, pp. 51–56, Feb. 1971.

Proc. 8th Congress of the International Union for Electrodep. and Surface Finishing, 1973, pp. 180–186.

Design Engineering, "New Ways to Skimp on Gold", pp. 45–46, Nov. 1980.

*Primary Examiner*—G. L. Kaplan

*Attorney, Agent, or Firm*—Walter G. Nilsen

[57] ABSTRACT

A silver electroplating procedure is disclosed which permits rapid and efficient plating and yields ductile, adherent silver films. The electroplating bath comprises silver complexed with an aliphatic polyamine compound with 3 to 20 carbon atoms. Particularly useful are such polyamines as diaminopropane (particularly 1,3-diaminopropane), diethylenetriamine, 1,4-diaminobutane, 1,6-diaminohexane, etc. The procedure is also useful for electroplating a variety of silver alloys. In addition, the bath is highly stable, does not adversely affect the base material being plated and does not contain hazardous materials which require special disposal procedures.

13 Claims, 1 Drawing Figure

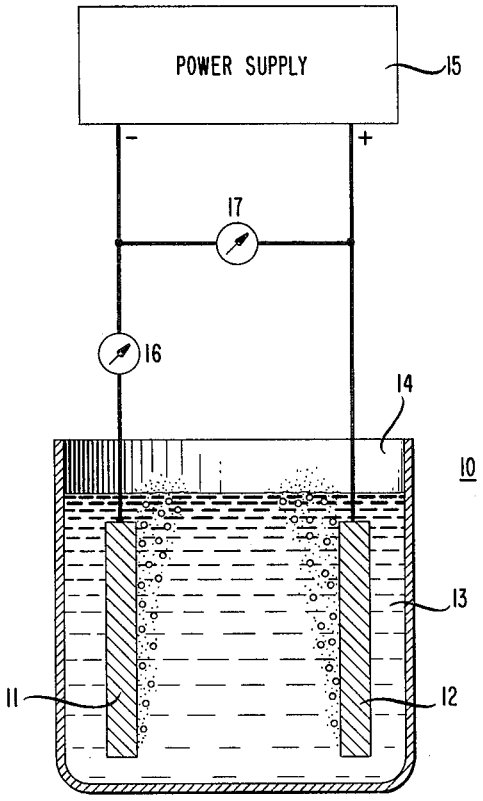
POWER SUPPLY
15
-
+
17
16
14
10
13
11
12

SILVER PLATING PROCEDURE

This application is a continuation of application Ser. No. 310,610, filed Oct. 13, 1981, now abandoned.

TECHNICAL FIELD

The invention is a process for electroplating silver from an aqueous plating bath.

BACKGROUND OF THE INVENTION

Precious metals are used as protective films on surfaces for a variety of reasons. In the jewelry trade, it is used to improve the appearance of an article as in gold plated jewelry. In other applications, it is used to protect against corrosion of metals and other surface materials. In the electrical arts, protective films made of precious metals are used as conduction paths in electrical circuits and as contact surfaces in devices with electrical contacts. Gold is used extensively in these applications with great success. However, the increased price of gold makes it attractive to look at other precious metals as protective films on various surfaces.

Silver and silver alloys are used extensively in a variety of industrial applications. Typical examples are the jewelry trade where such films are used to protect surfaces against corrosion and to improve appearance and the electrical arts in various electrical devices and electronic circuits. Silver is used as conducting paths in various types of printed circuits and integrated circuits.

Because of relative chemical inertness and reasonable hardness, silver is especially attractive as an electrical contact material in electrical connectors, relay contacts, switches, etc. Indeed, because of the increasing cost of gold, silver and silver alloys become more and more attractive economically as a contact material, surface material and in other applications. In many applications where gold is now used, it is often economically attractive to use silver, provided an inexpensive and efficient method of plating ductile and adherent silver is available.

Silver is also used as a brazing material and is sometimes applied by electroplating in the manufacturing of devices. Examples are planar triodes and surge protectors.

Highly desirable is a process for plating silver and silver alloys from an aqueous solution which is operable at high rates of deposition and yields silver and silver-alloy films which are ductile and adherent.

Conventionally, silver is electroplated from a cyanide-type bath in basic solution. Such processes have been described in a number of references, including: U.S. Pat. No. 2,777,810, issued to B. D. Ostrow on Jan. 5, 1957; U.S. Pat. No. 2,735,808, issued to Lawrence Greenspan on Feb. 21, 1956 and U.S. Pat. No. 2,666,738, issued to Otto Kardos on Jan. 19, 1954. Although such processes yield satisfactory results from a pollution, disposal and environmental point of view, it is often desirable to avoid cyanide baths. Also, replenishment of the baths often involves introduction of additional anions already present in the electroplating bath or different anions not already present in the bath. The introduction of such ions often complicates the silver electroplating process and often, because of buildup of the anion concentration, limits the lifetime of the electroplating bath. A cyanide-free silver electroplating process where anion concentration remains relatively constant is highly desirable.

K. Hosokawa et al in a paper published in *Proceedings of the 8th Congress of the International Union for Electrodeposition and Surface Finishing,* Forster-Verlag AG, Zurich, 1973, pp. 180–186, described some experiments in which silver is plated from an aqueous solution containing silver-ethylenediamine complex ion. Although the paper contains much discussion on the mechanism for electroplating from such a solution, the commercial value of the process is not apparent.

SUMMARY OF THE INVENTION

The invention is a process for electroplating silver (both pure metal and alloys with various metals) from an aqueous plating solution in which the plating solution comprises silver in the form of a complex ion and the complexing agent is one or more organic aliphatic polyamines with from 3 to 20 carbon atoms. Both straight chain and branch chain aliphatic groups may be attached to the amine groups. Typical complexing agents are diaminopropane (particularly 1,3-diaminopropane), diethylenetriamine, 1,4-diaminobutane, 1,6-diaminohexane, etc. Secondary polyamines such as N,N' dimethyl-1,3-propanediamine and tertiary polyamines such as N,N,N'N'tetramethylethylenediamine are also useful provided the total number of carbon atoms does not exceed 20. A limited number of substituents are also useful, such as hydroxy groups (i.e., 2-hydroxy-1,3-diaminopropane) and halogen groups such as chloride and bromide. It is preferred that the aqueous electroplating bath be alkaline (pH greater than 7.0) to avoid possible protonation of the silver complex and precipitation of silver. Additional substances may be added to the silver plating bath to control and adjust the pH (such as a buffer), to increase conductivity and to improve the properties of the plated metal. Typical substances used to improve the plated metal are lactones (i.e., phenolphthalein, phenolsulfone-phthalein, etc.), lactams, cyclic sulfate esters, cyclic imides and cyclic oxazolinones. Certain polyalkoxylated alkylphenols may also be useful. The process is useful for plating a variety of silver alloys including 10 mole percent silver, remainder copper, nickel and/or gold. Additional advantages are that the bath is not highly toxic and does not present a disposal problem or environmental problem. Replenishment can be accomplished by the addition of $Ag_2O$ which avoids the introduction of extraneous anions and maintains the pH of the electroplating bath and the bath chemistry is simple and highly stable which ensures long bath lifetimes.

BRIEF DESCRIPTION OF THE DRAWING

The FIGURE shows a typical apparatus useful in electroplating silver and silver alloys in accordance with the invention.

DETAILED DESCRIPTION

The invention is a process for electroplating silver metal and silver alloy in which a certain class of organic aliphatic polyamines is used as complexing agent in the silver-plating bath. Most useful are aliphatic polyamines with from 3 to 20 carbon atoms. Complexing agents with less than three carbon atoms yield useful results but tend to evaporate and limit the lifetime of the bath. Complexing agents with more than 20 carbon atoms, although useful, usually have limited solubility in aqueous solutions. Aromatic polyamines are also useful but often are difficult to work with (often poisonous with undesirable odor). Most preferred are the complexing agents 1,3-diaminopropane and diethylenetriamine because of the excellent quality of the silver plating obtained, especially at high plating current density (above 50 ASF). The preferred polyamine compounds have high solubility without the tendency to evaporate under the conditions of the electroplating process. Also, the composition of the bath is such that chemical attack on the surface being plated is minimal or insignificant. Replenishment of the bath is particularly convenient with the addition of $Ag_2O$. This replenishment procedure is very convenient since it does not add foreign anions to the solution and stabilizes the pH of the bath.

Within the limitations set forth above, the structure of the complexing agent may vary considerably. In particular, these complexing agents may contain certain substituents which do not significantly alter their complexing properties but may increase solubility, stability, electrochemical reduction (or oxidation) potential, etc. Typical substituents are hydroxyl groups, chloride and bromide. The complexing agents should be stable to the conditions of the electroplating process and in particular not undergo oxidation or reduction under the conditions of the electroplating process. For example, carboxylic acid groups should be avoided because such substituted aliphatic polyamines are generally not electrochemically stable.

Alloy plating may also be carried out using the polyamine complexing agent. Typical elements alloyed with silver are copper, nickel, cobalt, iron, gold, chromium, manganese, ruthenium, rhodium, palladium, platinum and iridium. Particularly useful are copper, nickel and gold. Preferred are alloys comprising at least 10 mole percent silver, remainder copper, gold and/or nickel. Other useful alloys are 40 mole percent silver, remainder gold, copper and/or nickel, 60 mole percent silver, remainder gold, copper and/or nickel, etc.

In addition, the silver alloy or essentially pure silver may contain small amounts of substances (generally other metals) which change or improve the properties of the plated silver. Up to 10 mole percent of such substances may be present in the electroplated material.

A large variety of counter ions (anions) may be used in the electroplating bath provided the anions are stable (chemically and electrochemically) and in particular are not subject to oxidation or reduction under conditions of the electroplating process. In addition, the anion should not interfere with the plating process by either chemical attack on the surface being plated or on the metal complex system. Typical anions are halides, nitrate, sulfate and phosphates. Chloride ion is preferred because of the low cost of silver chloride and the stability of the chloride ion under conditions of the electroplating process. Also, certain ions, including those set forth above, may be used as supporting electrolyte to increase conductivity of the electroplating bath. The cation used for the supporting electrolyte may be any soluble ion which does not interfere with the electroplating process. Alkali-metal ions (Na, K, Li) are particularly preferred because of solubility and stability. Generally, a separate supporting electrolyte is not used and conductivity is obtained from the silver-complex ions and any anions present including hydroxyl ions. Also, conductivity is obtained from any buffer system present such as phosphate ions, hydrogen-phosphate ions and/or dihydrogen-phosphate ions.

It is most preferred to use a silver bath in which the anions (for the most part) are hydroxyl ions. This is done by charging the bath with silver oxide (i.e., $Ag_2O$) together with the polyamine for complexing the silver ions. This procedure avoids introducing unnecessary anions to the electroplating bath. Optionally, a buffer system may be used to stabilize pH and the buffer substance introduces some ions to the electroplating bath.

Various compounds may be used as a source of silver. Silver oxide is preferred because of availability and stability and for the reasons set forth above. Also useful are various silver compounds such as silver chloride, silver bromide and silver nitrate. These compounds may be used initially to make the bath and to replenish the bath.

Generally, the pH of the bath may vary over large limits provided the silver-polyamine complex remains stable. Typically, good results are obtained in the pH range from 7.5 to 13.5. In this range, the silver-polyamine complex is most stable and the bath is not inconveniently corrosive. However, it should be recognized that the plating process may be used outside this pH range. The most preferred pH range is 9 to 12.5. The preference particularly applies when the preferred polyamines are used, namely, 1,3-diaminopropane and diethylenetriamine. Within this pH range, very rapid plating can be carried out with excellent plating results. Generally, a bath composition which permits rapid plating with more alkaline solution is preferred because of decreased attack on the surface being plated.

The plating process may be carried out with or without a buffer system. A buffer system is often preferred because it maintains constant pH and adds to the conductivity of the bath. Typical buffer systems are the phosphate system, borax, bicarbonate, etc. Preferred is the $HPO_4^{-2}/PO_4^{-3}$ system often made by adding an alkali-metal hydroxide (KOH, NaOH, etc.) to an aqueous solution of the hydrogen phosphate ion. Generally, the concentration of buffer varies from about 0.1 molar to 2 molar (about $1.0\pm0.2$ molar preferred) and the mole ratio of hydrogen phosphate to phosphate varies from 5/1 to 1/5 (with equal mole amounts within $\pm50$ percent preferred). These mole ratios often depend on the particular pH desired for the plating bath.

Various additives may be used to improve the performance of the bath and/or the properties of the silver plate. Various additives are described in a number of references including U.S. Pat. No. 4,265,715 issued to D. R. Rosegren et al on May 5, 1981.

The bath temperature may vary over large limits, typically from the freezing point to the boiling point of the electroplating bath. Often, the preferred plating temperature range depends on bath composition and concentration, plating cell design, pH and plating rate. Preferred temperatures for typical conditions are from room temperature to about 80 degrees C. with 30 to 65 degrees C. most preferred.

Various surfaces may be plated using the disclosed process. Usually, the plating would be carried out on a metal surface or alloy surface, but any conducting surface is sufficient. Also, electrolessly plated surfaces are useful. Typical metal and alloy surfaces are copper, nickel, gold, platinum, palladium, silver (as, for example, a surface electrolessly plated with silver and then electroplated with silver in accordance with the invention). Various alloy surfaces may also be used such as copper-nickel-tin alloys, beryllium-copper alloys, etc.

Typically, conventional anodes are used including platinum and platinized titanium. Also, consumable anodes may be used in which the anode comprises silver. With consumable anodes, silver is replenished from the anode.

The composition of the bath may vary over large limits provided it contains a source of silver and significant amounts of one or more polyamines of the class set forth above. In general, sufficient polyamine should be present to complex with the silver. Usually, it is advantageous if excess polyamine is present in the bath solution.

The silver concentration in the bath typically varies from 0.01 molar to saturation. Preferred concentrations often depend on plating rate, cell geometry, agitation, etc. Typical preferred silver concentration ranges for high-speed plating (50 to 1000 ASF) are higher than for low-speed plating (up to 50 ASF). Preferred silver concentration ranges for high-speed plating vary from 0.05 to 1.0 molar. For low-speed plating, the preferred range is from 0.02 to 0.2 molar. Where silver alloy plating is included, the alloy metal (usually copper, gold or nickel) replaces part of the silver in the composition of the plating bath. Up to 90 mole percent of silver may be replaced by alloy metal.

The amount of complexing agent (polyamine) may vary over large limits, typically from 0.5 times (on the basis of moles) the concentration of the silver species to saturation of the complexing agent. Generally, it is preferred to have excess complexing agent, typically from 2 times to 12 times the mole concentration of the silver species. Most preferred is about three times the mole concentration of silver. The preferred ranges of complexing agent in terms of silver species are the same for high-speed and low-speed baths.

The concentration of buffer may vary over large limits. Such concentrations often depend on cell design, plating rates, etc. Typically, the buffer concentration varies from 0.1 molar to saturation with from 0.2 to 2.0 molar preferred.

The bath is prepared in a variety of ways well known in the art. A typical preparation procedure which yields excellent results is set forth below: Equal amounts (11.3 gms) of 1,3-diaminopropane and water are mixed in a beaker. Heat of solution is sufficient to heat the resulting solution to about 60 degrees C. To this solution with vigorous stirring are added 11.6 gms of $Ag_2O$ in portions of about 0.5 gms approximately every two minutes. Since the resulting reaction is exothermic, the solution can be maintained at 60 degrees C. by adjusting the rate of addition of $Ag_2O$. The solution is filtered to remove solid matter (generally undissolved $Ag_2O$) and diluted to one liter.

To this solution is added 50 gms of $K_2HPO_4$. The pH is 11.3 at 25 degrees C. and can be adjusted upward by the addition of KOH and downward by the addition of $H_3PO_4$. This bath produces excellent silver platings at low plating rates such as about 50 ASF.

Another bath composition with 116 gm/l $Ag_2O$, 113 gm/l 1,3-diaminopropane and 173 gm/l potassium hydrogen phosphate yields excellent results at high plating rates, typically about 500 ASF.

The electroplating bath may be prepared with silver compounds other than $Ag_2O$. A typical bath, made as described above is 17 gm/l $AgNO_3$, 22 gm/l 1,3-diaminopropane and 101 gm/l $KNO_5$. The potassium nitrate is used as the supporting electrolyte and the pH is about 11. Electroplating is typically carried out at about 50 degrees C.

Electroplating experiments are carried out in an electroplating cell provided with means for high agitation. Temperature is maintained between 30 and 65 degrees C. with 55 degrees preferred. Current is passed through anode, electroplating bath and cathode. The electrical energy is supplied by a conventional power supply. Typical current densities are from 50 to 500 ASF. Typical thicknesses in these experiments are 40 to 150 microinches. The deposit is crack-free as determined by a scanning electron micrograph at 10,000 magnification. Both adherence and ductility are excellent. Plating rate is often determined by the thickness desired after a predetermined period of plating. For example, in a strip line plating apparatus (see, for example, U.S. Pat. No. 4,153,523, issued to D. E. Koontz and D. R. Turner on May 8, 1979 and U.S. Pat. No. 4,230,538, issued to D. R. Turner on Oct. 28, 1980) the strip line being plated is exposed to the plating solution for a set period of time (depending on the speed the strip is moving down the line and the length of the plating cell) and the plating rate is adjusted to give the desired thickness in this period of time. The advantage of high plating rates is that the strip can move down the line faster yielding greater output. Similar results are obtained with diethylenetriamine. Experiments carried out with 2 hydroxypropanediamine, 1,4-diaminobutane, 1,5-diaminopentane and 1,6-diaminohexane yield similar results.

The apparatus described in the above-cited patents are particularly advantageous for carrying out the process. They permit good control of the bath conditions, the rate of plating and permit rapid silver plating. The silver plating process is highly advantageous for plating electrical contact pins for electrical connectors such as described in the above references.

The FIGURE shows apparatus 10 useful in the practice of the invention. The surface to be plated 11 is made the cathode in the electrolytic process. The anode 12 is conveniently made of platinized titanium or may be made of various other materials such as oxides of platinum group metals, binder metal oxides, etc. Both anode and cathode are partially immersed in the electroplating bath 13 containing source of silver complex with an organic aliphatic polyamine. A container is used to hold the silver plating solution and the anode 12 and cathode 11 are electrically connected to source of electrical energy 15. An ammeter 16 and voltmeter 17 are used to monitor current and voltage. The voltage and current are controlled inside the source of electrical energy 15.

What is claimed is:

1. A process for electroplating a metallic substance on a surface, said metallic substance consisting of at least 90 mole percent silver, comprising the step of passing current through a cathode, electroplating bath and anode with a cathode potential great enough to electroplate silver, said electrochemical bath having a conductivity greater than $10^{-3}$ mho-cm and pH greater than 7 characterized in that the electroplating bath is an aqueous solution comprising a. a source of silver, said source of silver consisting essentially of silver-aliphatic polyamine complex in which the aliphatic polyamine has from 3 to 20 carbon atoms and substituents are selected from the group consisting of hydrogen, hydroxide, chloride and bromide and said aqueous solution has a silver concentration between 0.01 molar and saturation and an aliphatic polyamine concentration of from 2 to 12 times the mole concentration of silver and b. a buffer, said buffer consisting essentially of the hydrogen phosphate/phosphate system with buffer concentration between 0.1 and 2 molar and with the ratio of hydrogen phosphate to phosphate ion from 5/1 to 1/5.

2. The process of claim 1 in which the substituent is hydrogen.

3. The process of claim 2 in which the aliphatic polyamine is selected from the group consisting of 1,3-diaminopropane and diethylenetriamine.

4. The process of claim 3 in which the pH varies from 7.5 to 13.5.

5. The process of claim 4 in which the pH varies from 9.0 to 12.5.

6. The process of claim 1 in which the electroplating process is carried out at a temperature between room temperature and 80 degrees C.

7. The process of claim 6 in which the temperature is between 30 and 65 degrees C.

8. The process of claim 1 in which the silver is from 0.05 to 1.0 molar.

9. The process of claim 1 in which the plating current density is between 50 and 1000 ASF.

10. The process of claim 1 in which the silver in the electroplating bath is replenished by the addition of a source of silver.

11. The process of claim 10 in which the source of silver is silver oxide.

12. The process of claim 10 in which the source of silver is silver chloride or silver nitrate.

13. The process of claim 1 in which the plating current density is up to 50 ASF.

* * * * *